United States Patent [19]

Gemsjager

[11] 4,194,445

[45] Mar. 25, 1980

[54] SELF-ADJUSTING HUSKER

[75] Inventor: Helmut Gemsjäger, Brunswick, Fed. Rep. of Germany

[73] Assignee: Bühler-Miag GmbH, Brunswick, Fed. Rep. of Germany

[21] Appl. No.: 874,873

[22] Filed: Feb. 3, 1978

[30] Foreign Application Priority Data

Feb. 9, 1977 [DE] Fed. Rep. of Germany ..... 2705334

[51] Int. Cl.[2] ..... B02B 3/04

[52] U.S. Cl. ..... 99/618; 99/523; 99/620; 99/621; 100/168

[58] Field of Search ..... 99/523, 540, 574, 585, 99/618–622, 624, 625; 100/168; 241/232

[56] References Cited

U.S. PATENT DOCUMENTS

| | | | |
|---|---|---|---|
| 3,104,692 | 9/1964 | Davis et al. | 99/620 |
| 3,515,637 | 6/1970 | Reynolds et al. | 100/168 |
| 3,818,821 | 6/1974 | Kendall, Jr. | 99/585 |
| 3,835,766 | 9/1974 | Satake | 99/618 |
| 4,066,012 | 1/1978 | Satake et al. | 99/621 |

FOREIGN PATENT DOCUMENTS

| | | | |
|---|---|---|---|
| 797372 | 7/1958 | United Kingdom | 99/620 |
| 952668 | 3/1964 | United Kingdom | 99/619 |

*Primary Examiner*—George F. Mautz
*Assistant Examiner*—Timothy F. Simone
*Attorney, Agent, or Firm*—Michael J. Striker

[57] ABSTRACT

A grain husker has two decorticating rollers which are accommodated in a housing, one of the rollers being rotatable about a stationary axis, while the other roller is mounted on a carrier which, in turn, is mounted on the housing for pivoting relative thereto in such a manner that the movable roller moves with the carrier closer and farther away from the stationary axis of the first-mentioned roller. A drive for the rollers includes a motor, a driving pulley mounted on the output shaft of the motor, and idler pulley and a driven pulley of the movable roller, all of these components being also mounted on the carrier for displacement therewith, the drive further including a driven pulley of the stationarily mounted roller and an endless element which is trained about all of the above-mentioned pulleys. The driving and idler pulleys, as well as the driven pulley of the movable roller are located in the corners of an imaginary triangle, while the driven pulley of the stationarily mounted roller is located within the imaginary triangle so that the required length of the endless element will always be the same irrespective of the amount of displacement of the movable roller with the carrier within the working range thereof. Thus, as the decorticating rollers wear off, the movable roller will move closer to the stationary axis due to the weight of the components mounted on the carrier or acting thereon, and there is no need for retensioning the endless element during the movement of the movable roller within its working range.

24 Claims, 7 Drawing Figures

Fig. 6
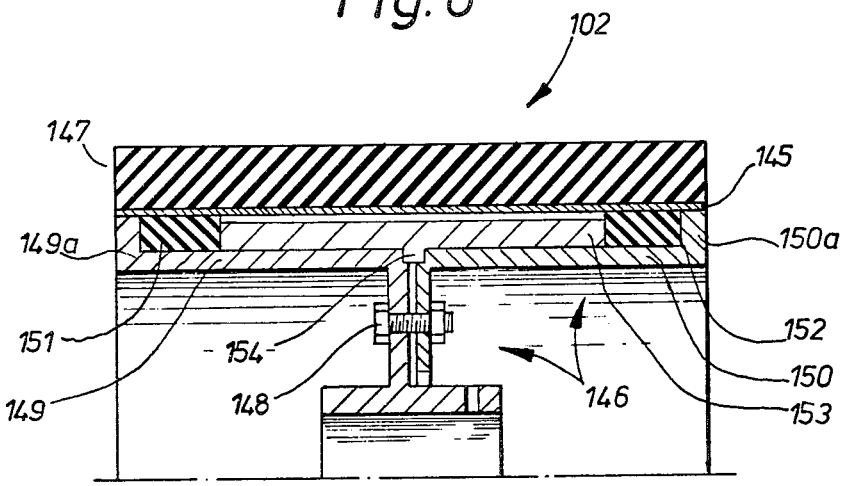
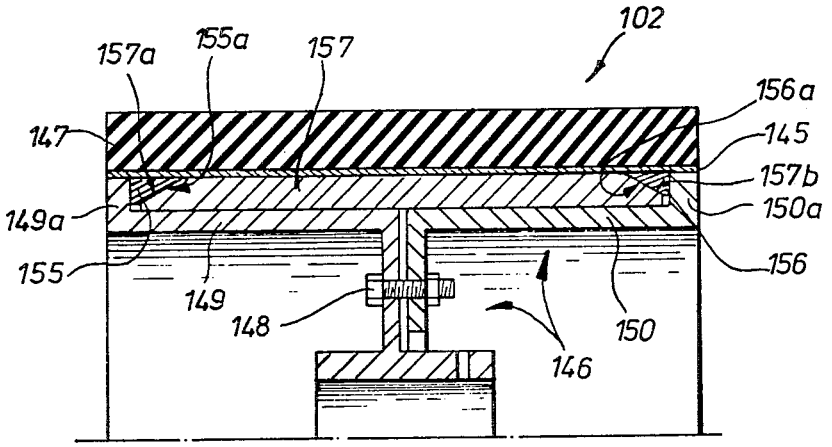
Fig. 7

SELF-ADJUSTING HUSKER

BACKGROUND OF THE INVENTION

The present invention relates to a decorticating device or machine in general, and more particularly to a device for stripping husks from grains, which machine is commonly known as a husker.

Grain huskers of various constructions are already known and have found a widespread use in various fields of human endeavor, especially in mills, cereal-manufacturing plants, and the like. These machines are used for separating the husks of grains, such as, for instance, rice or barley, from the soft nuclei of those grains. Usually, these machines include a housing which has an upper inlet for the grain to be husked or decorticated, and a lower outlet for the products of the husking operation. Then, a pair of decorticating rollers is accommodated in the interior of the housing, one of the rollers being mounted on the housing for rotation about a stationary axis, while the other roller is movable relative to the first-mentioned roller as a result of its being mounted on a carrier which is pivotably mounted on the housing. The movably mounted roller is pressed with a predetermined force against the stationarily mounted roller, the rollers being driven in rotation by a motor which is equipped with a driving pulley, while each of the rollers has a driven pulley, an endless element, such as a belt, being trained about the driving pulley, the driven pulleys, and at least one idler pulley.

It will be appreciated that the husker, in order to be marketable and usable, will have to satisfy several requirements. Of course, the husker will have to have the required throughput and will have to satisfy the requirements as to the quality of the husking operation performed thereby. However, an important consideration to be borne in mind when constructing the husker is that the construction of the driving arrangement for driving the decorticating rollers is of a crucial importance inasmuch as the complexity of and the manufacturing and operating expenses involved in connection with this driving arrangement determine, more than anything else, the overall cost of this machine.

Among the conventional decorticating machines of this type, there is already known from the Swiss Pat. No. 326,591 a husker in which a driven pulley is mounted on each of the shafts of the two decorticating rollers. In this machine, an endless driving belt is trained about these two driven pulleys and about two tensioning and guiding pulleys the positions of both of which are variable, the endless driving belt being advanced by a motor. This conventional arrangement is disadvantageous in that the angle of contact of the driving belt with the driven pulley associated with the stationarily mounted decorticating roller is quite small, as a result of which there exists the danger of slippage of the driving belt. In view of the fact that, on the one hand, the decorticating rollers must have a certain position relative to one another in order to achieve an unproblematical decorticating operation and, on the other hand, the elastic decorticating layer of the rollers wears off quite rapidly, a frequent adjustment of the position of the movably mounted decorticating roller is required to assure the proper relative disposition of the decorticating rollers; hence, a frequent re-tensioning of the driving belt is also necessary. This is quite disadvantageous not only because the operator of the machine must spend a considerable amount of time on adjusting the position of the movably mounted roller and re-tensioning the driving belt, but also in view of the fact that the operator is required to possess a certain degree of skill and must be attentive during the readjustment and re-tensioning in order to be able to properly perform the above-mentioned operations.

A different machine of this type is know from the British Pat. No. 797,372 wherein an electromotor which is accommodated in the housing of the machine drives the stationarily mounted decorticating roller via a first endless driving belt, while the movable decorticating roller is driven in rotation by a second endless driving belt. In this machine, the movement of the second driving belt is derived from the movement of the shaft of the stationarily mounted decorticating roller. Even this machine is disadvantageous in that the angle of contact of the second driving belt with the pulley which is mounted for transportation with the movable decorticating roller is quite small, and in that the wear of the decorticating layers of the decorticating rollers must be frequently compensated for by adjusting the position of the movably mounted decorticating roller and by re-tensioning the second driving belt.

Similar disadvantages are also present in the husker which is disclosed in the German published patent application DT-OS No. 23 04 704 in which a driving belt which is set in motion by a motor is trained about the driven pulleys mounted on the respective shafts of the two decorticating rollers, about a tensioning pulley, a guiding pulley and a driving pulley associated with the motor. Even in this machine, the driving belt contacts the driven pulleys associated with the decorticating rollers, the driving pulley and even the guiding pulley only to a small extent, and the tensioning pulley must be manually adjusted as to its position in dependence on the wear of the decorticating layer of the respective decorticating rollers, at frequent intervals, in order to assure that the driving belt has the necessary tension, which is particularly important in this machine in order to assure that a sufficient frictional resistance transmission is obtained at the minimum angle of contact of the driving belt with the respective pulleys.

A further conventional husker has been revealed in the published German patent application DT-OS No. 22 36 676 in which the driving arrangement includes a gear transmission incorporating three meshing gears, a first gear of this gear transmission being driven in rotation by an electric motor, a second of these gears driving the movable decorticating roller via a first belt drive, and the third gear driving the stationarily mounted decorticating roller via a second belt transmission which is controlable as to its speed. The two separate belt transmissions for the two decorticating rollers have advantageous angles of contact with their respective pulleys. Furthermore, when the position of the movable decorticating roller is changed on account of the wear of the decorticating layers of the decorticating rollers, it is not necessary to retension the driving belt which drives the movable decorticating roller. In view of this, this conventional machine is quite advantageous as to its function. However, this satisfactory function is achieved only at a relatively high material and manufacturing expense. In addition thereto, this machine is also disadvantageous in that it is not maintenance-free, which is a particular disadvantage especially when it cannot be assured that skilled maintenance personnel will be available whenever needed.

A husker of the German published patent application DT-OS No. 26 12 349 is another of the conventional machines of the type here under consideration, which includes a housing, two rollers which are mounted in the housing at a distance from each other and in mutual parallelism, a main shaft which carries one of the rollers and which is mounted in the housing for turning about a stationary axis, and a countershaft which carries the other roller and is supported in the vicinity of the free end of an arm which, in turn, is mounted on a base plate by means of a rotating axle which extends at a distance from and parallel to the stationary axis so that the countershaft can be moved with respect to the main shaft toward and away from the latter while the two shafts remain parallel to each other. The rotating axle is mounted in the housing in a predetermined relative position thereof with respect to the part of the countershaft which carries the respective roller. The arm which is pivotably movable about the rotating axis either above or below, supports only the removable decorticating roller and its driven pulley, while all other driving, driven, tensioning or guiding pulleys as well as the driving motor are arranged at fixed locations of the housing. The positional readjustment of the movable decorticating roller, which is necessitated by the unavoidable wear of the decorticating layers of the decorticating rollers, is here achieved manually by means of a handwheel, and the necessary retensioning of the endless driving belt is achieved by displacing the motor together with its driving pulley by means of an adjusting arrangement and a pivotably mounted carrier plate for the motor. Thus, the operator of even this machine must readjust not only the position of the movable mounted decorticating roller, but also the tension of the driving belt at frequent intervals and in dependence on the degree of the wear of the decorticating layers of the decorticating rollers, in order to assure that the machine will work properly.

Furthermore, there has also already been proposed in connection with other conventional huskers to so construct the decorticating rollers and the mounting means thereof that the rollers can be easily replaced. Thus, as disclosed, for instance, in the German published patent application DT-OS No. 26 12 349, each of the decorticating rollers may consist of two parts which are detachably connected to one another, that is, of a hub body which is mounted on the driven shaft of the respective decorticating roller for transrotation therewith, and a cylindrical jacket which is provided with the elastic decorticating layer at its outer circumference. Thus, after a substantial wear of the decorticating layer, it is merely necessary to remove the cylindrical jacket together with the worn decorticating layer thereof, and to substitute a new jacket therefor, while the hub body can remain on the shaft thereof without any positional or other change thereof.

SUMMARY OF THE INVENTION

Accordingly, it is a general object of the present invention to avoid the disadvantages of the prior art.

More particularly, it is an object of the present invention to propose a decorticating machine, particularly a grain husker, which is not possessed of the above-mentioned disadvantages of the prior-art machines or devices of this type.

A further object of the present invention is to so construct a husker or similar machine that the previously existing need for manually readjusting the position of the movably mounted roller to compensate for the wear of the rollers, and the attendant retensioning of the endless driving belt, can be avoided.

A still further object of the present invention is to develop a driving arrangement for use in the machine here under consideration in which the endless driving element has a sufficient area of contact with the respective pulleys and thus reliably transmits motion from the driving to the driven pulleys and hence from the motor to the decorticating rollers.

A concomitant object of the present invention is to provide a husker which is inexpensive to manufacture, so simple in construction and operation that it can be handled even by unskilled personnel, and reliable nevertheless.

In pursuance of these objects and others which will become apparent hereafter, one feature of the present invention resides in a decorticating device, particularly a grain husker which, briefly stated, comprises a support; a pair of cooperating decorticating rollers one of which is mounted on the support for rotation about a stationary axis; a carrier; means for rotataby mounting the other decorticating roller on the carrier; means for displaceably mounting the carrier on the support for movement of the other decorticating roller closer to and farther away from said stationary axis; and means for rotating the decorticating rollers, including two driven pulleys one of which is connected to the one and the other to the other decorticating roller for joint rotation therewith, at least one idler pulley, a driving pulley, means for setting the driving pulley in rotation including a motor, and means for transmitting the rotation of the driving pulley to the driven and idler pulleys, including at least one endless element trained about all of the pulleys, at least the motor, the driving pulley and other driven pulley being supported on the carrier for displacement therewith. Advantageously, the support is a housing which has an upper inlet for the material to be decorticated and a lower outlet for the decorticated material, the decorticating rollers being arranged intermediate the inlet and the outlet. An especially advantageous device of the present invention is obtained when said one idler pulley is also supported on the carrier for displacement therewith.

Advantageously, the carrier includes a frame, especially a rectangular frame, which includes a plurality of beams in which the driving pulley, the other driven pulley and on the idler pulley are directly or indirectly supported. It is especially advantageous when the displaceable mounting means mounts the carrier on the support for pivoting relative to the latter about a pivoting axis.

In order to achieve a stable mounting of the carrier on the support, on the one hand, and to keep the dimensions of the decorticating device to a minimum, the displaceable mounting means is constructed as a pivot shaft which is mounted on the support and has a cantilevered end portion that extends beyond the support, the carrier being mounted on the cantilevered end portion of the pivot shaft, and the rotatable mounting means includes a supporting element which has a cantilevered end section extending from the carrier oppositely to the cantilevered end portion, the supporting element mounting the other decorticating roller for rotation. The displaceably mounting means further includes at least two bearings which are located a distance from each other and which mount the pivot shaft on the support for pivoting relative thereto; the bearings are advantageously arranged close to the end walls of the housing constituting the support, which end walls extend substantially normal to the pivot axis. A particularly simple and advantageous embodiment of the basic concept of the present invention is obtained when the displaceably mounting means further includes a tubular member which extends between and is connected to the above-mentioned end walls of the housing, the pivot shaft and the bearings being accommodated within the tubular member.

According to a currently preferred advantageous aspect of the present invention, the carrier is affixed to the cantilevered end portion of the pivot shaft, and the cantilevered end section of the supporting element extends next to the hub of the other decorticating roller. To advantage, the supporting element includes a tube which is rigidly connected to the carrier and has the above-mentioned cantilevered end section, and another end section which extends beyond the carrier to the opposite side thereof from the cantilevered end section. Then, it is advantageous for the rotatably mounting means to further include a supporting shaft, which is connected to the other decorticating roller for joint rotation, and two bearings one of which is accommodated in the cantilever and the other end section. Then, the above-mentioned other driven pulley is mounted on the supporting shaft at the above-mentioned opposite side of the carrier for joint rotation with the supporting shaft.

A driving arrangement of a particularly simple and reliable construction is obtained when the driving pulley, the other driven pulley and the idler pulley are so mounted on the carrier as to be located in the corners of an imaginary triangle, the one driven pulley being located within the imaginary triangle. Then, it is further advantageous when the pivot shaft which mounts the carrier on the support for pivoting relative thereto is located between the other driven pulley and the idler pulley.

In other to avoid the need for a separate tensioning pulley, the device of the present invention is so constructed as to further comprise means for adjustably mounting one of said driving and idler pulleys on the carrier for an adjustment of the position thereof relative to said carrier for such one pulley to serve as a tensioning pulley for the transmitting means. An especially compact construction and an adjustment which is rather easy to accomplish are obtained when the driving pulley is mounted on an output shaft of the motor for rotation therewith and serves as the tensioning pulley; then, the adjustably mounting means includes means for displaceably connecting the motor to the carrier, the displaceably connecting means advantageously including a mounting plate which is mounted on the carrier for displacement relative thereto and for arrest in a selected one of a plurality of positions, the motor being rapidly mounted on the mounting plate.

In order to make the endless element, such as a driving belt, rather accessible and replaceable without opening the housing of the device, it is further advantageous when the above-mentioned driving, driven and idler pulleys are mounted on the housing in a cantilevered fashion. Advantageously, the device further comprises means for pressing said other decorticating roller against said one decorticating roller with a predetermined force, and including means for controlling the magnitude of such a force. The pressing means may include at least one cylinder-and-piston unit which is interposed between the support and the carrier. However, especially when the displaceably mounted means mounts the carrier on the support for pivoting about a pivot axis, the pressing means may include a massive body which is mounted on the carrier for movement relative thereto between a plurality of positions in which the moment of the body about the pivot axis varies, the controlling means including means for moving the body between and for blocking the body in the above-mentioned positions.

It is further advantageous when the displaceably mounting means mounts the carrier for movement between an extended position in which the decorticating rollers contact each other and a retracted position in which the decorticating rollers are remote from each other. Then, it is advantageous to further equip the device with means for displacing the carrier between the extended and the retracted positions thereof. Advantageously, the displacing means displaces the carrier into its retracted position when, for one reason or another, no material to be decorticated is delivered to the decorticating rollers, in other words, to avoid wear of the decorticating rollers during such idling periods.

In view of the fact that, owing to the rapid wear of the decorticating layers of the decorticating rollers, the latter need to be replaced relatively often, it is very important to make the decorticating rollers easily accessible. According to a further facet of the present invention, this is achieved in that the housing which constitutes the support is formed with an opening in one of the above-mentioned end walls for introducing and withdrawing the decorticating rollers therethrough, the opening being closable by a lid.

The construction of the respective decorticating rollers which has been discussed previously in connection with the description of the prior art, while rendering it possible to rapidly exchange the worn-out part of the decorticating roller together with the decorticating layer, is still disadvantageous in that the user of the machine equipped with such conventional decorticating rollers must discard, simultaneously with the worn-out decorticating layer, also the molded or welded jacket together with the connecting flange thereof, inasmuch as the manufacturer only delivers complete jackets and not only some components thereof. This is very uneconomical inasmuch as the connecting flange of the jacket is to be subjected to a mechanical treatment and, hence, does in fact not constitute any inexpensive throw-away part.

The present invention also sets out to avoid this disadvantage by redesigning the construction of the decorticating roller. According to the present invention, this is achieved in that the roller, particularly the husking or decorticating roller, includes a hub body, a cylindrical straight hollow jacket separate from and surrounding the hub body, and means for connecting the jacket to the hub body. In order to keep the amount of material of the part of the roller which is later to be discarded to a minimum, the above-mentioned hollow jacket is so constructed as to be relatively thin-walled and is provided with a decorticating layer, such as of a synthetic plastic material or rubber, which is relatively thick, so as to obtain a possibly longest lifespan of the roller between the jacket-exchanging operations.

According to a further aspect of the present invention, the connecting means includes means for rigidly connecting the hollow jacket to the hub body. Advantageously, the hub body includes two sections which have a common axis and which are displaceable toward and away from each other along the common axis. Then, the rigidly connecting means advantageously includes at least one connecting member which is interposed between the hub body and the hollow jacket and which is so configurated as to press radially against the hub body and against the hollow jacket during the displacement of the hub sections toward each other. When the connecting means is constructed in the above manner, is obtained a secure connection of the components of the roller, on the one hand, and an especially simple exchange of the jacket flowing the wear of its decorticating layer, on the other hand.

According to the present invention, the connecting member may be a ring of an elastically deformable material with a high coefficient of friction, such as rubber or a synthetic plastic material. Then, it is advantageous when the hub sections have respective flanges which together bound an annular recess accommodating the ring, and when the rigidly connecting means further includes an additional ring identical with the abovementioned ring and also accommodated in the recess, and a distancing ring interposed between the ring and the additional ring and pressing the same against respective flanges during the displacement of the hub sections toward each other.

However, the connecting member may also be advantageously so constructed as to include two annular connecting elements one of which is axially interrupted and both of which have conical surfaces which contact each other, the annular connecting elements being arranged coaxially to the hollow jacket. Under these circumstances, it is advantageous for the hub sections to have respective flanges which together bound an annular recess accommodating the connecting elements of the connecting member. Then, it is further advantageous when the rigidly connecting means further includes an additional connecting member which is identical with the abovementioned connecting member and also accommodated in the recess, and a distancing portion interposed between the connecting member and the additional connecting member and pressing the same against the hollow jacket during the displacement of the hub sections towards each other.

Preferably, the axially interrupted connecting element is an outer, and the other connecting element is an inner element of the connecting member and of the additional connecting member, respectively. Then, the distancing portion is advantageously integral with the inner elements of the connecting member and of the additional connecting member.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 6 is a longitudinal sectional view of a decorticating roller of the present invention; and FIG. 7 is a view similar to FIG. 6 but of a modification of the decorticating roller.

DETAILED DISCUSSION OF THE PREFERRED EMBODIMENTS

Figure 1:
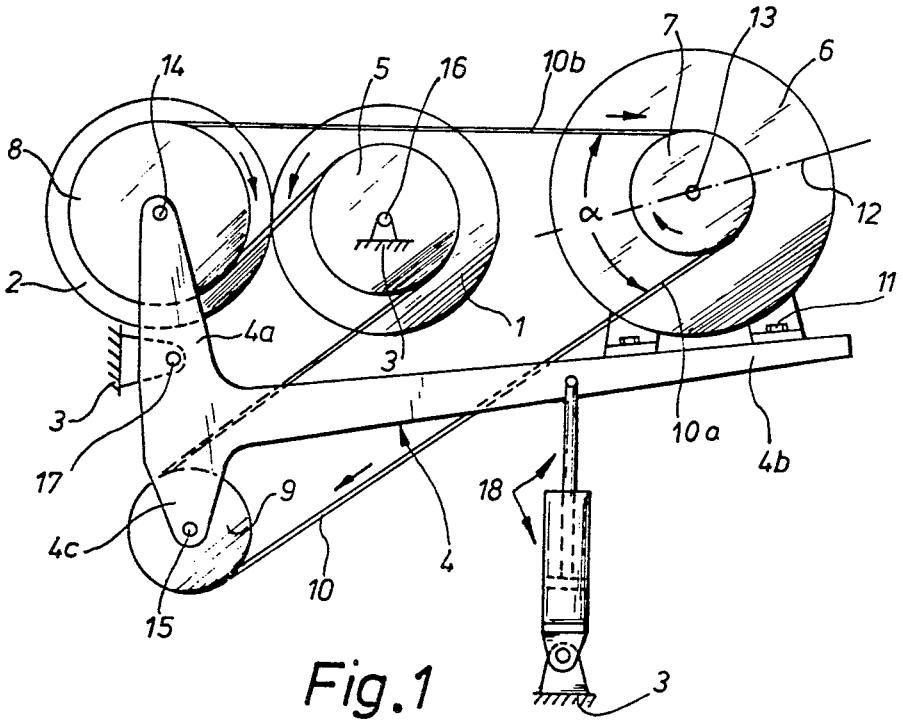
FIG. 1 is a side elevational view showing in principal the construction of the driving arrangement of the husker of the present invention.

Referring now to the drawing in detail, and first to FIG. 1 thereof, it may be seen that the indispensable components of the driving arrangement of the present invention are illustrated therein. The husker of the present invention includes a pair of husking and decorticating rollers 1, 2 of which, as usual, one decorticating roller 1 is mounted on a housing of the machine for rotation about a stationary axis, the housing having been omitted from the simplified view of FIG. 1 and being only indicated by the reference numeral 3. On the other hand, the other decorticating roller 2 is mounted for rotation on a carrier 4 which is pivotally mounted in the housing 3. The carrier 4 is illustrated as a multi-arm lever, and the entire driving arrangement for driving the decorticating rollers 1, 2, with the exception of a belt pulley 5 serving to drive the decorticating roller 1, is mounted on the carrier 4. The driving arrangement further includes an electric driving motor 6, for instance, an alternating current motor, a driving belt pulley 7 which is mounted on the output shaft of the driving motor 6 for joint rotation therewith, a driven belt pulley 8 for driving the decorticating roller 2 which is mounted on the carrier 4 coaxially with the decorticating roller 2, a guiding belt pulley 9 which is also mounted for rotation on the carrier 4, as well as a driving belt 10 which is endlessly trained about the belt pulleys 5, 7, 8 and 9 and which is preferably configurated as a flat belt.

The driving belt pulley 7 is so arranged as to simultaneously serve as a tensioning pulley for the driving belt 10. For tensioning the driving belt 10, the driving motor 6 and, with the latter, also the driving belt pulley 7, are mounted on the carrier 4 for a positional adjustment, for instance, by means of screws 11 which are received in elongated slots which are provided in the carrier 4 and which have not been illustrated, the elongated slots being so oriented as to permit the screws 11, when the latter are loosened, to shift therein generally along the plane in which the driving belt 10 is located. The adjustment or the positional displacement of the driving belt pulley 7 for tensioning the driving belt 10 is preferably accomplished in the direction of a symmetry line 12 of an angle $\alpha$ which two instantaneous sectons 10*a* and 10*b* then leading to and away from the driving belt pulley 7 enclose with each other. The adjustment of the driving belt pulley 7 in the direction of the line 12 is advantageous inasmuch as the originally selected geometry of the driving belt 10 is maintained, for all intents and purposes, virtually unchanged when the decorticating roller 2 progressively approaches the stationary axis of the decorticating roller 1 during the operation of the husker and in correspondence to the wear of the decorticating rollers of the decorticating rollers 1, 2.

It may also be seen in FIG. 1 that respective axes of rotation 13, 14, and 15 of the belt pulleys 7, 8 and 9 are located in the corners of an imaginary triangle within which there is located the belt pulley 5 of the roller 1 together with the stationary axis 16 thereof. Furthermore, it can be ascertained from FIG. 1 that a pivot axis 17 of the carrier 4 is located between the driven belt pulley 8 for driving the movable decorticating roller 2, and the guiding belt pulley 9. As a result of these expedients, there is obtained an optimum angle of contact of the driving belt 10 with all of the belt pulleys 5, 7, 8 and 9 and, consequently, the highest possible degree of frictional resistance transmission between the driving belt 10 and the belt pulleys 5, 7, 8 and 9, respectively, as it is required for a technically unproblematical force transmission.

The weight of the carrier 4 and of the various components mounted thereon, particularly of the movable decorticating roller 2 and the driving motor 6, as well as the weights of the belt pulleys 7, 8, 9, will result in a moment tending to pivot the carrier 4 about the pivot axis 17 and, as a result of this moment and proportionately thereto, the movable decorticating roller 2 will be pressed against the decorticating roller 1. However, as also illustrated in FIG. 1, there may be provided a cylinder-and-piston arrangement 18 whose cylinder is affixed to the housing 3 and the piston rod of which is connected to the carrier 4. By controlling the pressure of a hydraulic fluid acting on the arrangement 18, the working pressure of the decorticating roller 1, 2, that is the force with which the movable decorticating roller 2 is pressed against the stationary decorticating roller 1, can be additionally regulated. In other words, when the pressurized fluid at the proper pressure is delivered to the desired side of the piston of the cylinder-and-piston arrangement 18, a smaller or a greater, clockwise or counterclockwise, moment is imparted to the carrier 4 as desired, as a result of which the working pressure of the decorticating rollers 1, 2 is either enhanced or attenuated and can be varied in this manner, that is, by controlling the pressure and/or the direction of action of the pressurized fluid. However, the cylinder-and-piston arrangement 18, in addition to the above-discussed variation of the working pressure, also serves to move the movable decorticating roller 2 into its working position and to return the movable decorticating roller 2 into its rest position. As illustrated in FIG. 1, the movement of the piston rod of the cylinder-and-piston arrangement 18 out of the cylinder moves the carrier 4 and thus the movable decorticating roller 2 mounted thereon into the rest position of the latter, while the retraction of the piston rod into the cylinder of the cylinder-and-piston arrangement 18 results in movement of the movable decorticating roller 2 into its working or operative position illustrated in the drawing.

As already mentioned before, the mounting of the driving arrangement, especially of the relatively heavy driving motor 6, on the carrier 4, results in a situation where the weights of these components which are mounted on the carrier 4, together with the own weight of the carrier 4, subject the carrier 4 to a permanent force moment which strives to pivot the carrier 4 in the clockwise direction as illustrated in the drawing, thus also striving to displace an arm **4*a* of the carrier 4 on which the movable decorticating roller 2 is mounted, in the same direction. This moment then results in a force acting on the movable decorticating roller 2, the magnitude of which depends on the respective arm lengths of the respective forces, the force which acts on the movable decorticating roller 2 constantly pressing the decorticating roller 2 against the decorticating roller 1 and thus assuring the working pressure between the two decorticating rollers 1, 2 which is needed for a proper performance of the decorticating operation. This working pressure resulting from the action of the weight of the various components on the carrier 4 which, as mentioned previously, can be either enhanced or attenuated by the action of the cylinder-and-piston arrangement 18, remains unchanged even when the decorticating layers of the decorticating rollers 1, 2 progressively wear off. This is attributable to the fact that the above-mentioned force moment or, in other words, the force which results from the force moment and which acts on the movable decorticating roller 2, progressively pivots the movable decorticating roller 2 in the clockwise direction as illustrated in the drawing as the decorticating layers of the decorticating rollers 1, 2 wear off and, consequently, as the outer diameters of the decorticating roller 1, 2 diminish. In other words, the arm 4*a* of the carrier 4 is moved to the desired extent in the clockwise direction so that the working pressure which has been set at the time of the commencement of the operation of the husker remains constant during the entire operation of the husker, that is, until the decorticating layers of the decorticating rollers 1, 2 have been completely worn out. In this connection, it may be useful to mention that the pivoting of the arm 4*a* which carries the movable decorticating roller 2 occurs automatically and proportionately to the degree of wear of the decorticating layers of the decorticating rollers 1, 2**, while the working pressure is being maintained constant, without any need for any manual re-adjustment after the commencement of the operation of the husker.

During the above-mentioned pivoting of the carrier 4, together with its arms **4*a*, 4*b* and 4*c*, and also together with the movable decorticating roller 2 and the belt pulleys 7, 8, 9, the shortenings of some sections of the driving belt 10 between some of the pulleys 5, 7, 8 and 9 will be exactly compensated for by lengthenings of other sections of the driving belt 10 extending between other belt pulleys 7, 8, 9 and 5, as a result of the particular arrangement of the drive of the present invention. As a result of this compensatory maintenance of the same length of the driving belt 10, it is no longer necessary to re-tension the driving belt 10 after the initial tensioning thereof before the commencement of the operation of the husker of the present invention. In other words, the originally selected tension of the driving belt 10 will be maintained, without any readjustment, even as the decorticating layers of the decorticating rollers 1, 2 wear off and thus the outer diameters of the decorticating rollers 1, 2** diminish.

Figure 2:
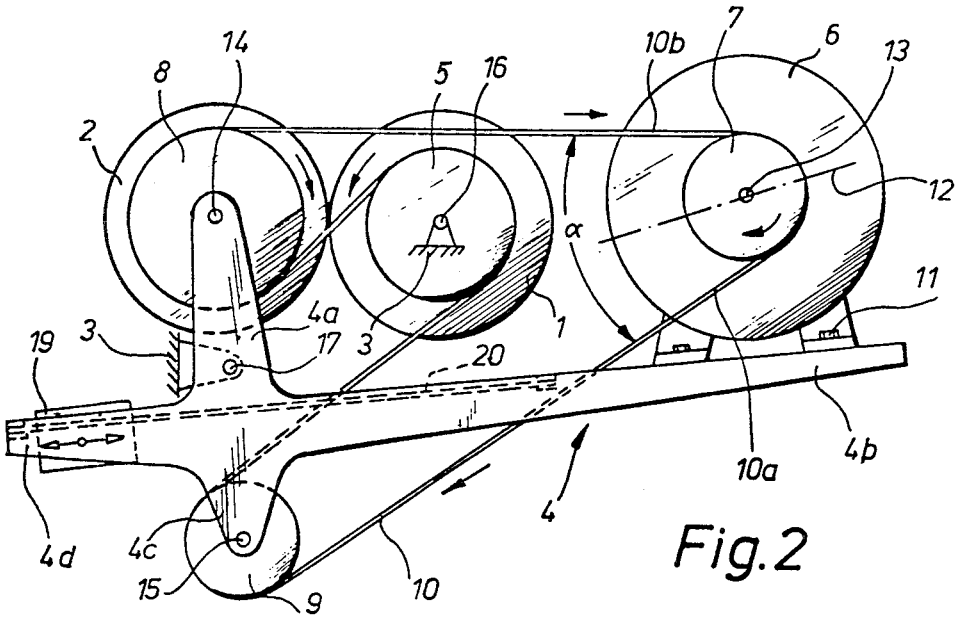
FIG. 2 is a view similar to FIG. 1 of a modification having an adjustable working pressure between the rollers of the husker.

The modified arrangement illustrated in FIG. 2 basically corresponds to that discussed above in connection with FIG. 1 so that the same reference numerals have been used to designate like parts. The main difference between the modifications of FIGS. 2 and 1 resides in the fact that the carrier 4 of FIG. 2 is additionally provided with an arm **4*d* which constitutes a coaxial extension of the arm 4*b* but beyond and to the other side of the arms 4*a* and 4*c*. A weight 19, for instance, a massive body, is arranged on the arm 4*d* to serve as a regulating means for regulating the working pressure of the decorticating rollers 1, 2. The weight 19, as illustrated, is supported on a track, for instance, a rod or a threaded spindle 20 which extends over the entire length of the arm 4*d* and partially also over the length of the arm 4*b*. The position of the weight 19 on the track 20 is adjustable. Depending on the fact whether the weight 19 is located to the left of the pivot axis 17 of the carrier 4 on the arm 4***d*, or to the right of the pivot axis 17 on the arm 4*b*, the weight 19 subjects the carrier 4 to a counterclockwise or a clockwise moment. It will be appreciated that the counterclockwise moment of the weight 19 will reduce the working pressure of the decorticating rollers 1, 2, while the clockwise moment will increase such working pressure. A fine control or variation of the working pressure is rendered possible due to the fact that the position of the weight 19 on the track or spindle 20 can be selectively adjusted. This is particularly advantageous when the husker is to be used for decorticating different kinds of grains or the like, which may call for a change in the working pressure of the decorticating rollers 1, 2 as the husker is being switched from one type of grain to another. For moving the movable decorticating roller 2 between its extended or operative position and its retracted or rest position, there may also be used a moving arrangement, which has not been illustrated but which may, for instance, include a cylinder-and-piston arrangement such as that illustrated in and described in connection with FIG. 1, or a different mechanically, electromechanically or electrohydraulically operated arrangement.

Figure 3:
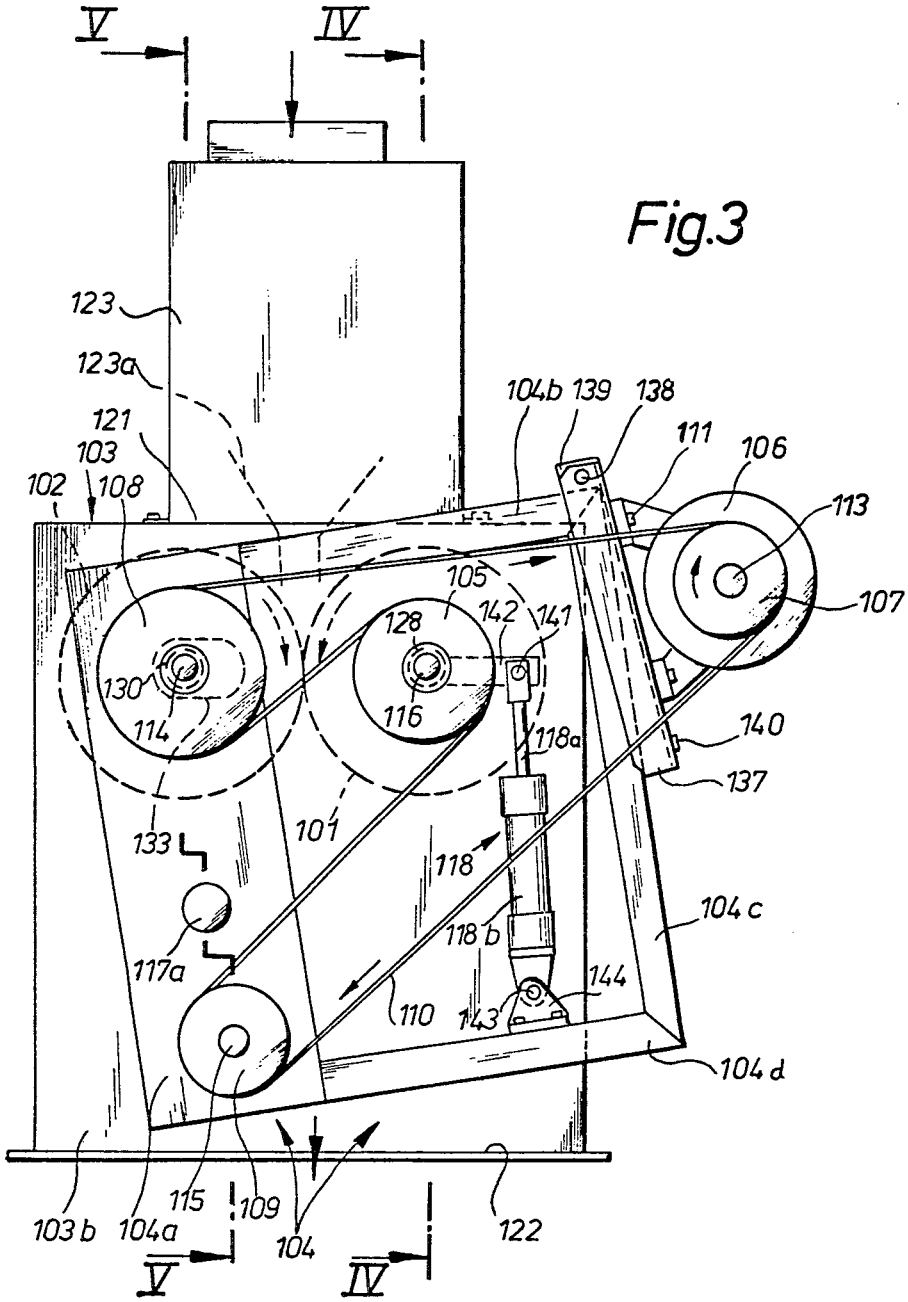
FIG. 3 is a simplified side-elevational view of the husker of the present invention.
Figure 5:
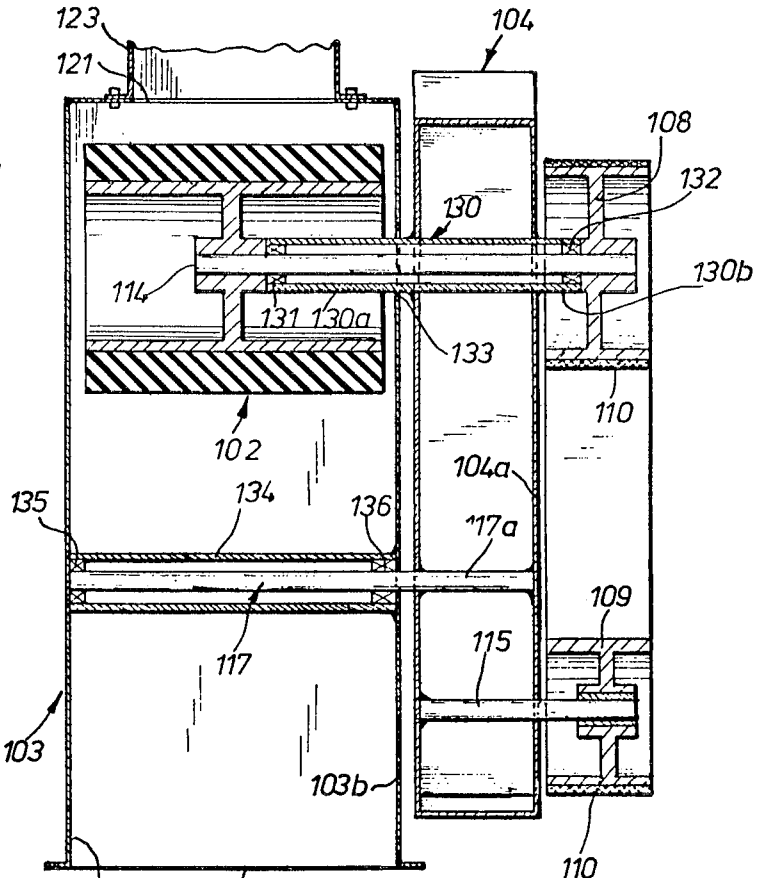
FIG. 5 is a sectional view taken on line V—V of FIG. 3.
Figure 4:
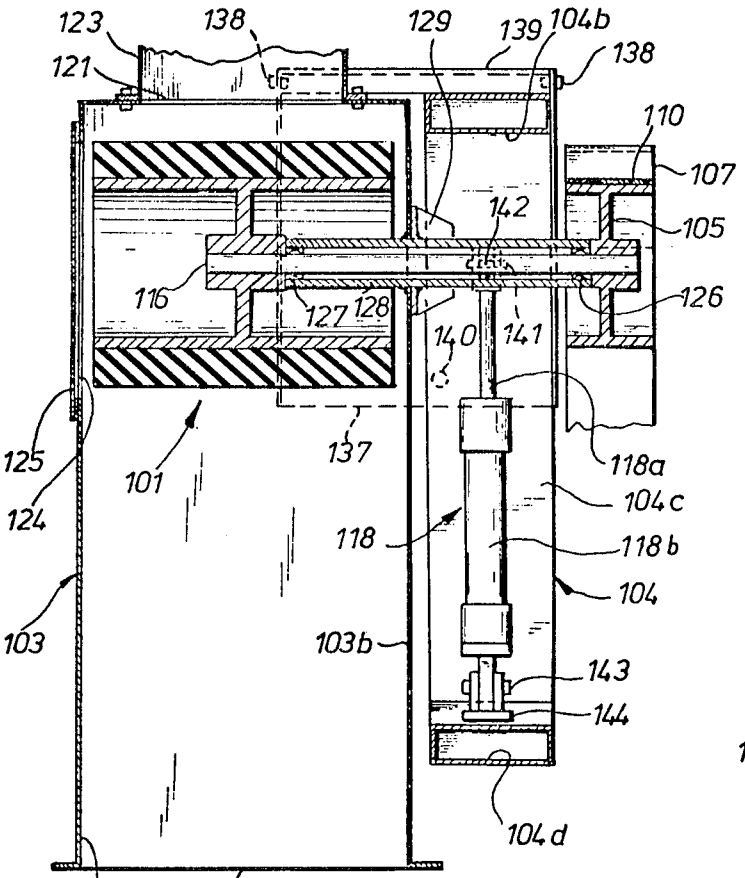
FIG. 4 is a sectional view taken on line IV—IV of FIG. 3.

Having so discussed the principles of construction and operation of the various components of the husker of the present invention, attention will not be directed to a husking machine for stripping the husk from, for instance, rice which is illustrated in FIGS. 3 to 5 and which, while being in principle of the same construction as that discussed above in connection with FIGS. 1 and 2, is still different therefrom in actual structural design so that a different set of reference numerals is being used to indicate the various components of this husking machine. Thus, the reference numeral 103 indicates a housing of the husker, the housing 103 being provided with an inlet opening 121 for the introduction of the material to be decorticated into the interior of the housing 103, and with an outlet opening for the product of the decorticating operation which is designated with the reference numeral 122 and is located at the lower portion of the housing 103, while the inlet opening 121 is located at the upper end of the housing 103. In actual use of the machine of the present invention, non-illustrated conventional material-supplying arrangement will be arranged upwardly of the inlet opening 121 on the housing 103, in the form of a feeding container and a controlledly operated pusher, both of which are surrounded by an inlet box 123 and serve to feed the supplied grains or the like in a trough 123*a* which guides the grains or the material similar thereto which is to be decorticated into the drawing-in region of the decorticating rollers, here identified by the reference numerals 101 and 102. Non-illustrated lateral cover plates, for instance, sheet-metal plates, prevent the material passing through the interior of the housing 103 from escaping in the axial direction of the decorticating rollers 101 and 102. In order to be able to remove, replace or exchange the decorticating rollers 101 and 102, the housing 103 is provided with an opening 124 which can be closed by means of a lid 125.

Here again, the decorticating rollers 101 and 102 constitute a cooperating pair of rollers. The decorticating roller 101 is mounted in the housing 103 for rotation about a stationary axis, while the decorticating roller 102 is movably mounted on the housing 103. More particularly, the stationary decorticating roller 101 is mounted on one end of a shaft 116 for joint rotation therewith, while a belt pulley 105 is mounted at the other end of the shaft 116, also for joint rotation therewith. The shaft 116 is mounted, by means of bearings 126, 127, in a tubular member 128. As particularly clearly seen in FIG. 4, the tubular member 128 is rigidly connected with the housing 103 and is reinforced by ribs 129, for instance, of sheet metal.

On the other hand, the movable decorticating roller 102 is mounted, in the same manner, at one end of a shaft 114 for joint rotation therewith, while a belt pulley 108 is jointly rotatably mounted on the shaft 114 at the other end thereof. The shaft 114 passes through a tubular member 130 and is supported therein by means of bearings 131, 132. The tubular member 130 so passes through a frame 104, which serves the same purpose as the abovediscussed carrier 4, that two tubular stubs 130*a*, 130*b* extend beyond a beam 104*a* of the frame 104 in a cantilevered fashion. The tubular stub 130*a* passes through a slot 133 of a lateral wall 103*a* of the housing 103, from the exterior to the interior of the housing 103 and terminates at the hub of the movable decorticating roller 102.

As particularly clearly seen in FIG. 5, the tubular member 130 is rigidly connected with the frame 104, preferably by welding. The frame 104 is generally rectangular and includes, in addition to the above-mentioned beam 104*a*, three other beams 104*b*, 104*c* and 104*d* which are rigidly connected with one another, for example, by welding, as illustrated in FIG. 3. The frame 104 is jointly rotatably connected to a cantilevered portion 117*a* which extends outwardly of the housing 103 and is a portion of the shaft 117. The shaft 117 is rotatably supported in two bearings 135, 136 which are arranged, close to the lateral or end walls 103*a*, 103*b* of the housing 103, in a tubular member 134 which, in turn, rigidly connects the lateral or end walls 103*a*, 103*b* to one another. As a comparison of FIGS. 3 and 5 will reveal, an axle 115 is connected to the beam 104*a* of the frame 104 underneath the cantilevered portion 117*a* of the shaft 117 and a guiding belt pulley 109 is rotatably mounted on the pivot axle 115.

A U-shaped support plate 137 is positionally adjustably mounted on the frame 104 in the region of the beam 104*c* thereof, and an electric driving motor 106 is affixed to the support plate 137 by means of screws 111. The electric driving motor 106 has an output shaft 113 and a driving belt pulley 107 is jointly rotatably mounted on the output shaft 113 of the motor 106. The support plate 137 is tiltably supported on two coaxial bolts 138 which are threaded into a transverse support 139 which is welded to the beam 104*b* of the frame 104. An adjusting spindle 140 constitutes the third fixed point of the support plate 137. The adjusting spindle 140 is able, during its adjusting movement, to tilt the support plate 137 closer and further away from the frame 104, about the common axis of the bolts 138. As a result of the corresponding adjustment of the position of the support plate 137, the driving belt pulley 107, which simultaneously serves as a tensioning pulley, is moved away from the belt pulleys 108 and 109 so that a driving belt 110 can be adjusted as to its tension.

As clearly visible in FIG. 3, the driving belt 110 is endlessly trained, at optimum angles of contact, about the belt pulleys 105, 107, 108 and 109 and can be, following a corresponding de-tensioning, very easily slipped off the belt pulleys 105, 107, 108 and 109, especially in view of the fact that all of these pulleys 105, 107, 108 and 109 are mounted in a cantilevered fashion.

A cylinder-and-piston arrangement 118 serves to control and maintain a predetermined working pressure between the decorticating rollers 101, 102, and also to move the decorticating roller 102 into its operating position and its return into its rest position. The arrangement 118 has a piston rod 118*a* which is pivotally connected by a bolt 141 with a lever 142 which, in turn, is weldingly connected to the tubular member 128 that is rigidly connected to the housing 103 so that the bolt 131 constitutes a fixed point during the actuation of the cylinder-and-piston arrangement 118. On the other hand, a cylinder 118*b* of the arrangement 118 is pivotally connected by a bolt 143 to a bearing block 144 which is rigidly attached to the beam 104*b* of the frame 104. In order to achieve the desired working pressure between the decorticating rollers 101, 102, as well as to move the movable decorticating roller 102 into its operative position, for instance, pressurized air at 2 atmospheres gauge is delivered into the cylinder 118*b*, while for example pressurized air at, say, 6 atmospheres gauge is supplied to the cylinder 118*b* to return the movable decorticating roller 102 into its rest position.

FIGS. 6 and 7 illustrate the construction of the decorticating rollers according to the present invention in detail. Inasmuch as the two decorticating rollers 101, 102 are fully identical, only one decorticating roller 102 will be described, and it will be understood that the other decorticating roller 101 will be of the same construction.

In the first modification illustrated in FIG. 6, the decorticating roller 102 includes a cylindrical jacket 145 and a hub body 146 by means of which the decorticating roller 102 is to be mounted on the shaft 114. The cylinder jacket 145 is configurated as a straight, thin-walled hollow cylinder of steel which is equipped with a vulcanized thick layer 147 of rubber.

The hub body 146 is constituted by two hub sections 149, 150 which are displaceable relative to one another along the common axis by means of screws 148. Each of the hub sections 149, 150 has a respective flange 149*a*, 150*a*, the sections 149, 150 thus together bounding a recess between the flanges 149*a*, 150*a* in the assembled position of the sections 149, 150. The cylindrical jacket 145 and the hub body 146 are positively connected to one another by means of a clamping arrangement interposed between the same. The clamping arrangement includes an annular rubber element 151 which abuts the flange 149*a*, another annular rubber element 152 which abuts the flange 150*a*, and a distance ring 153 which is interposed between the rubber elements 151, 152 and keeps them apart. The distance ring 153 has a projection 154 which is received between the hub sections 149, 150 which are so configurated as to together bound a groove for receiving the projection 154. Thus, the distance ring 153 is axially arrested and blocked against shifting in the axial direction of the hub sections 149, 150.

When the hub sections 149, 150 are moved toward each other by tightening the screws 148 which are arranged at an equal distribution along a circle, the flanges 149*a*, 150*a* press the rubber elements 151, 152 against the distance ring 153, as a result of which each of the annular rubber elements 151 and 152 expands transversely of the axis of the hub sections 149, 150 and is thus pressed with a high pressure against the cylindrical jacket 145 and the hollowcylindrical region of the hub section 149 or 150 associated therewith, thus establishing a positive connection between the cylindrical jacket 145 and the hub body 146. Now, when the decorticating layer 147 is worn out and, hence, the cylindrical jacket 145 is to be replaced, it is merely necessary to discontinue the positive connection between the cylindrical jacket 145 and the hub sections 149 and 150 of the hub body 146 by loosening the screws 148, as a result of which the two annular rubber elements 151, 152 are de-tensioned. Then, the cylindrical jacket 145, together with the worn-out layer 147, can be axially slid off the hub body 146. The introduction and the fixation of a new cylindrical jacket 145 is accomplished in the same manner but in the reverse sequence.

FIG. 7 illustrates a modification which is so much similar to that of FIG. 6 that the same reference numerals have been used for corresponding parts. The main difference between these two modifications resides in the construction of the positive connecting means for attaching the cylindrical jacekt 145 to the hub body 146. The positive connecting arrangement, in FIG. 7, includes two axially slotted outer rings 155, 156 of steel which respectively abut the flanges 149*a*, 150*a* and includes a conical engaging surface 155*a* or 156*a*. Furthermore, the connecting arrangement includes a steel inner ring 157 which is common to the two outer rings 155, 156 and which is located inbetween the same, the inner ring 157 having contact surfaces 157*a*, 157*b* which are engaged by the engaging surfaces 155*a*, 156*a*. The achievement and discontinuance of the positive connection during the mounting of a new or dismounting of a worn-out cylindrical jacket 145 corresponds in principle to that discussed above in connection with FIG. 6.

The progress which is achieved when the present invention is resorted to mainly resides in the fact that the novel decorticating machine or husker no longer needs any readjustment of the position of the movable decorticating roller or any re-tensioning of the driving belt, when the decorticating layer of each of the decorticating rollers has been subjected to wear, inasmuch as the movable decorticating roller automatically follows, and compensates for, the diminution of the dimensions of the decorticating rollers due to wear thereof and the respective increases or decreases in the length of the various sections of the driving belt also automatically compensate for each other. Another progressive aspect of the present invention is to be seen in the fact that the working pressure of the decorticating rollers, based on the arrangement according to the present invention, is the result of the weight of the driving arrangement and thus is maintained constant until the full wear of the decorticating layers. Other advantages obtained by the present invention is the slip-free transmission of the driving force based on the large angles of contacts of the driving belt with the pulleys, the inexpensive and maintenance-free construction and the simple operation. In addition thereto, the especially economical construction of the decorticating roller is also of advantage inasmuch as only an inexpensive throw-away part need be discarded together with the worn-out decorticating layer.

It will be understood that each of the elements described above, or two or more together, may also find a useful application in other types of constructions differing from the types described above.

While the invention has been illustrated and described as embodied in a grain husker, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A decorticating device, particularly a grain husker, comprising a support; a pair of cooperating decorticating rollers one of which is mounted on said support for rotation about a stationary axis; a carrier; means for rotatably mounting the decorticating roller on said carrier; means for displaceably mounting said carrier on said support for movement of said other decorticating roller closer to and farther away from said stationary axis; and means for rotating said decorticating rollers, including two driven pulleys one of which is connected to said one and the other to said other decorticating roller for joint rotation therewith, at least one idler pulley, a driving pulley, means for setting said driving pulley in rotation including a motor, and means for transmitting the rotation of the driving pulley to said driven and idler pulleys, including at least one endless element trained about all of said pulleys, said motor with said driving pulley, said other driven pulley and said idler pulley being supported on said carrier for displacement therewith in such a manner that said other decorticating roller is urged by gravitational force toward the roller mounted for rotation about said stationary axis to automatically compensate for any wear of the peripheral roller surfaces, without changing the tension in said endless element.

2. A device as defined in claim 1, wherein said support includes a housing having an upper inlet for the material to be decorticated and a lower outlet for the decorticated material; and wherein said decorticating rollers are arranged intermediate said inlet and said outlet.

3. A device as defined in claim 1, wherein said carrier includes a frame including a plurality of beams; and wherein said driving pulley and said other driven pulley are supported on said beams.

4. A device as defined in claim 1, wherein said displaceably mounting means mounts said carrier on said support for pivoting relative to the latter about a pivoting axis.

5. A device as defined in claim 5, wherein said displaceably mounting means includes a pivot shaft mounted on said support and having a cantilevered end portion extending beyond said support, said carrier being mounted on said cantilevered end portion of said pivot shaft; and wherein said rotatably mounting means includes a supporting element which has a cantilevered end section extending from said carrier oppositely to said cantilevered end portion, and which mounts said other decorticating roller for rotation.

6. A device as defined in claim 6, wherein said displaceably mounting means further includes at least two bearings which are located at a distance from each other and which mount said pivot shaft on said support for pivoting relative thereto.

7. A device as defined in claim 7, wherein said support includes a housing having two end walls extending substantially normal to said pivot axis; and wherein said bearings are arranged close to said end walls of said housing, respectively.

8. A device as defined in claim 8, wherein said displaceably mounting means further includes a tubular member which extends between and is connected to said end walls of said housing; and wherein said pivot shaft and said bearings are accommodated within said tubular member.

9. A device as defined in claim 6, wherein said carrier is affixed to said cantilevered end portion of said pivot shaft; wherein said other decorticating roller has a hub; and wherein said centilevered end section of said supporting element extends next to said hub of said other decorticating roller.

10. A device as defined in claim 10, wherein said supporting element includes a tube which is rigidly connected to said carrier and has said cantilevered end section, and another end section which extends beyond said carrier to the opposite side thereof from said cantilevered end section.

11. A device as defined on claim 11, wherein said rotatably mounting means further includes a supporting shaft connected to said other decorticating roller for joint rotation, and two bearings one of which is accommodated in said cantilevered and the other in said other end section of said tube.

12. A device as defined in claim 12; wherein said other driven pulley is mounted on said supporting shaft at said opposite side of said carrier, for joint rotation therewith.

13. A device as defined in claim 1; wherein said driving pulley, said other driven pulley and said one idler pulley are so mounted on said carrier as to be located in the corners of an imaginary triangle; and wherein said one driven pulley is located within the imaginary triangle.

14. A device as defined in claim 13, wherein said displaceably mounting means includes a pivot shaft which mounts said carrier on said support for pivoting relative thereto and which is located between said other driven pulley and said idler pulley.

15. A device as defined in claim 14; and further comprising means for adjustably mounting one of said driving and idler pulleys on said carrier for an adjustment of the position thereof relative to said carrier for such one pulley to serve as a tensioning pulley for said transmitting means.

16. A device as defined in claim 15, wherein said motor has an output shaft and said driving pulley is mounted on said output shaft of said motor for rotation therewith; and wherein said adjustably mounting means includes means for displaceably connecting said motor to said carrier.

17. A device as defined in claim 16, wherein said displaceably connecting means includes a mounting plate which is mounted on said carrier for displacement relative thereto and for arresting in selected one of a plurality of positions, said motor being rigid with said mounting plate.

18. A device as defined in claim 1, wherein said rotating means further includes means for mounting said pulleys in a cantilevered manner.

19. A device as defined in claim 1; and further comprising means for pressing said other against said one decorticating roller with a predetermined force.

20. A device as defined in claim 19, wherein said pressing means includes means for controlling the magnitude of said force.

21. A device as defined in claim 20, wherein said pressing means includes at least one cylinder-and-piston unit which is interposed between said support and said carrier.

22. A device as defined in claim 20, wherein said displaceably mounting means mounts said carrier on said support for pivoting about a pivot axis; wherein said pressing means includes a massive body mounted on said carrier for movement relative thereto between a plurality of positions in which the moment of said body about said pivot axis varies; and wherein said controlling means includes means for moving said body between and for blocking said body in said positions.

23. A device as defined in claim 1, wherein said displaceably mounting means mounts said carrier for movement between an extended position in which said decorticating rollers contact each other and a retracted position in which said decorticating rollers are remote from each other; and further comprising means for displacing said carrier between said extended and retracted position thereof.

24. A device as defined in claim 1, wherein said support includes a housing having two end walls which are substantially normal to said stationary axes, an opening in one of said end walls for introducing and withdrawing said decorticating rollers therethrough, and a lid for closing said opening.

* * * * *